United States Patent [19]

Kippenberg et al.

[11] Patent Number: 4,503,010

[45] Date of Patent: Mar. 5, 1985

[54] PROCESS OF PRODUCING A COMPOUND MATERIAL OF CHROMIUM AND COPPER

[75] Inventors: Horst Kippenberg, Herzogenaurach; Heinrich Haessler, Wendelstein; Manfred Huehnlein, Nuremberg, all of Fed. Rep. of Germany

[73] Assignee: Siemens Aktiengesellschaft, Berlin and Munich, Fed. Rep. of Germany

[21] Appl. No.: 513,479

[22] Filed: Jul. 13, 1983

[30] Foreign Application Priority Data

Jul. 16, 1982 [DE] Fed. Rep. of Germany ..... 3226504
Jun. 24, 1983 [DE] Fed. Rep. of Germany ..... 3322866

[51] Int. Cl.[3] ..... B22F 3/00

[52] U.S. Cl. ..... 419/27; 75/245; 200/264; 252/512

[58] Field of Search ..... 75/245; 200/264; 252/512; 419/27

[56] References Cited

U.S. PATENT DOCUMENTS 3,818,163 6/1974 Robinson ..... 200/144 B
3,957,453 5/1976 Hässler et al. ..... 75/245
4,147,909 4/1979 Hässler et al. ..... 200/265

*Primary Examiner*—Leland A. Sebastian
*Attorney, Agent, or Firm*—F. W. Powers; J. L. James

[57] ABSTRACT

In the method according to the invention, Cr powder is poured into a degased mold, which can be made of graphite. On this Cr powder a piece of low-oxygen copper is placed. Subsequently, the mold is closed with a porous cover, which can also be made of graphite. Then the mold is degased in a high-vacuum furnace at room temperature until a pressure of better than $10^{-4}$ mb is reached. Thereafter, the furnace temperature is increased to as high as possible a temperature below the melting point of copper. This furnace temperature is maintained constant until an internal pressure in the furnace of better than $10^{-4}$ mb is reached. Subsequently, without intermediate cooling, the furnace temperature is further increased slowly to a final value of 100 degrees K. to 200 degrees K. above the melting temperature of the copper. This temperature is then maintained until the porosity contained in the Cr powder is completely filled up by the liquid copper.

9 Claims, No Drawings

PROCESS OF PRODUCING A COMPOUND MATERIAL OF CHROMIUM AND COPPER

BACKGROUND OF THE INVENTION

The invention relates to a method of producing a compound material of chromium and copper which is used as contact material for medium voltage vacuum power switches.

A Cr Cu compound with about 40 to 60% Cr has been proven successful as a contact material for vacuum power switches. The Cu component ensures sufficient electrical and thermal conductivity, while the skeleton material Cr diminishes burnoff and also, having, in comparision with tungsten, a low melting point of about 2173 degrees K., eliminates the danger of harmful thermal electron emission. In addition, the Cr greatly reduces the tendency of the contact pieces to weld together and it also possesses good getter properties.

Because of the miscibility gap in the system Cr-Cu, only powder metallurgical methods can be considered for the production of the compound material CrCu for the desired concentration range of about 40 to 60% Cr. The most commonly used method involves the making of compacts of Cr powder or CrCu powder mixtures, the pores of which are filled with liquid Cu after the sintering. However, such sintering-impregnating methods as well as the other powder metallurgical methods are difficult to control because of the tendency of the chromium to oxidize. In particular there is danger that pore or impregnation defects will result due to poor wettability of certain grain surfaces or due to the formation of passive layers. Even if these defects are of the order of only 5 to 50 microns, they can impair the switching properties. In the practice this results in a certain scatter in circuit breaking performance.

In other existing methods, porous blanks, for example, are produced by the pressing or pouring of metal power. These blanks either consist of pure Cr powder or are admixed with one or more additional powder additives to obtain a liquid phase during sintering. The subsequent sintering under high vacuum or in pure shielding gas at temperatures of 1573 degrees K. to 1773 degrees K. leads to a desired formation of sinter bridges between the powder grains. This increases the skeleton stability and permitts safe handling of the porous sintered blanks after the sintering process. In the next step the blanks are placed in impregnation molds or on impregnation substrates, are given as application or backing an amount of impregnation metal, such as copper, corresponding to the pore volume, and are again heated under high vacuum or in pure shielding gas above the melting temperature of the impregnation metal. This causes as infiltration of the porous skeleton to occur due to capillary forces.

The above described impregnation method for the production of the Cr-Cu compound materials, does not produce completely faultless impregnations despite very careful working procedures. This is due essentially to three reasons:

When recharging the furnaces between the sintering and impregnating processes, the skeleton surface of the highly getter-active Cr skeletons will acquire a new covering of thin oxide films or chemisorbed gas films which make wetting with the liquid impregnation metal difficult. For thermodynamic reasons these oxidation processes occur below about 1000 degrees K. even under high vacuum and in pure shielding gas, because oxygen partial pressures below $10^{-10}$ mb cannot be obtained in economically feasible furnaces. As a result of this phenomenon, impregnation defects occur which manifest themselves in the form of micro-cavities and pores.

As a result of the sintering process and the formation of sinter bridges connected therewith, inaccessible pore regions are obtained which are only partially reached or not reached at all by liquid impregnation metal. Also the possibility of bringing reducing substances, such as carbon, to the skeleton metal via the liquid impregnating metal phase is limited, so that in these residual pore regions caused by sinter bridge formation, there are residual oxides which impair the switching capacity of the material.

The stiffening effect of solid sinter bridges considerably reduces the deformability of the skeleton, material. As the Cr skeleton which is impregnated with copper or copper alloys, is cooled from the infiltration temperature of the liquid impregnating metal, there occurs, because of the different thermal expansion between Cr and Cu, a volume deficit which cannot be absorbed by joint uniform shrinkage of the skeleton and impregnating metal. This phenomenon can also lead to lattice defects and to microporosities, invisible under a light-optical microscope, which may lower the quality of the material for high-power switching application.

Attempts have been made to avoid these problems. For instance, Cr powder and Cu powder may be mixed, thereby suppressing direct contact of the Cr grains to a large extent, and in the subsequent sintering process only sporadic deformation-inhibiting sinter bridges will form; or in some cases no bridges will form. Although this production process removes the steric impediment of the Cr particles, sufficient switching performance cannot be achieved with such a material. This is due to the interaction between the Cu powder, normally contaminated with about 500 ppm oxygen, and the getter-active Cr powder. Already below 1273 degrees K., i.e. 1000° C., as $Cu_2O$ dissociation sets in, the oxidation-avid Cr powder is oxidized to a higher degree. Because of the high heat of oxidation of Cr, stable surface oxides will form which cannot be removed by normal vacuum degasing.

SUMMARY OF THE INVENTION

It is the object of the present invention to develop a new method whereby a high-grade contact material, composed of chromium and copper, can be produced which meets the requirements of medium voltage vacuum power switches at an operating voltage of up to 36 kV and circuitbreaking currents above 30 kA, wherein the above-mentioned sources of defects as well as the use of Cu powder with a high oxygen content can be avoided.

In general, the invention features a method for producing a compound material of chromium and copper as contact material for medium voltage vacuum power switches, having the steps of pouring Cr powder into a degased mold, placing a piece of low-oxygen copper on the Cr powder, closing the mold with a porous cover, degasing the mold in a high-vacuum furnace at room temperature until a pressure of better of $10^{-4}$ mb is reached, increasing the furnace temperature to as high as possible a temperature below the melting point of copper, maintaining the furnace temperature at a constant level until a constant internal pressure in the furnace of better than $10^{-4}$ mb is reached, and increasing further the furnace temperature without intermediate cooling, to a final value of 100 degrees K. to 200 degrees K. above the melting point of copper and maintaining this temperature until the porosity contained in the Cr powder is completely filled up by liquid copper.

In preferred embodiments the furnace temperature is initially raised to 1273 degrees K. (+50 degrees K. and −20 degrees K.); the mold is degased to a pressure in the range of $10^{-5}$ mb and the constant internal pressure in the furnace is in the range of $10^{-5}$ mb; the furnace temperature is maintained at a constant level for about one hour; the final value in the range of 100 degrees K. to 200 degrees K. is maintained for 20 to 30 minutes; alumino-thermally produced chromium is used, and the Cr powder produced therefrom has a particle size distribution between 50 and 200 microns; the Cr powder, produced from alumino-thermally produced chromium, with particle size having fractions of at least 150 microns is used.

In another preferred embodiment electrolytically produced chromium is used and the Cr powder produced therefrom has a particle size distribution between 25 and 200 microns.

In another preferred embodiment a graphite-mold is used.

Other features and advantages of the present invention will become apparent from the following detailed description, and from the claims.

For a full understanding of the present invention, reference should now be made to the following detailed description.

DETAILED DESCRIPTION

According to the invention, the problem is solved by pouring Cr powder into a degased mold; then a piece of low-oxygen copper is placed on the Cr powder; subsequently the mold is closed with a porous cover; then the mold is degased in a high-vacuum furnace at room temperature until a pressure of better than $10^{-4}$ mb is reached; thereafter the furnace temperature is increased to as high as possible a temperature below the melting point of copper; this furnace temperature is maintained constant until a constant internal pressure in the furnace of better than $10^{-4}$ mb is reached; and subsequently, without intermediate cooling, the furnace temperature is further increased to a final value of 100 degrees K. to 200 degrees K. above the melting point of copper and this temperature is maintained until the porosity contained in the Cr powder mixture is completely filled up by the liquid copper.

The furnace temperature just below the melting point of copper may, in an industrial environment, be $$1273 \text{ degrees K.} \left( \begin{matrix} +50 \text{ degrees K.} \\ -20 \text{ degrees K.} \end{matrix} \right).$$

The furnace is kept constant at this temperature for about one hour, preferably reaching an internal pressure in the furnace in the range of $10^{-5}$ mb. The holding time at the temperature above the melting point of copper is preferably 20 to 30 minutes.

For the method according to the invention, alumino-thermally or electrolytically produced chromium may be used. In the former case the Cr powder should have a particle size distribution of 50 to 200 microns, but preferably with fractions of at least 150 micron; in the latter case the particle size may be lower, namely in the range of 25 micron and up.

Further it has proved desirable to use a graphite mold, because carbon is soluble in small amounts in the liquid copper and is therefore used as a reducing agent for Cr oxide impurities via transport in the liquid phase.

What is especially advantageous in the invention is that no strength-increasing sintering process with the formation of stable sinter bridges is carried out; instead one proceeds directly from the Cr powder charge contained in the mold. Without recharging the furnace and without additional handling of sintered blanks, the pore volume of the powder charge can be filled up completely with liquid copper, so that a virtually pore-free compound material results.

The invention will now be described more specifically with reference to the following embodiments:

When using alumino-thermally produced chromium with a maximum oxygen content of 500 ppm, the Cr powder produced therefrom having a particle size with fractions of at least 150 micron is filled into a previously degased graphite mold. The crucible has a diameter, for example, of 85 mm and a length of 250 mm and is filled with Cr powder to a height of about 180 mm. On the Cr powder is placed a solid piece of low-oxygen copper, which fills the remaining crucible volume. The crucible is then closed with a porous graphite cover and is degased in a high-vacuum furnace at room temperature until a pressure in the range of $10^{-5}$ mb, that is, better than $10^{-4}$ mb, is reached. Thereafter heating is begun, which is interrupted whenever the pressure rises to about $10^{-4}$ mb. At a temperature of about $$1273 \text{ degrees K.} \left( \begin{matrix} +50 \text{ degrees K.} \\ -20 \text{ degrees K.} \end{matrix} \right),$$

that is, below the melting point of copper ($T_{SM}=1356$ degrees K.), the actual degasing temperature is reached, which is maintained for one hour, but at least until an internal furnace pressure of better than $10^{-4}$ mb is again reached. Subsequently, without intermediate cooling, the temperature is further increased, to a final value of 100 degrees K. to 200 degrees K. above the melting point of copper. The temperature may be, for example e.g. 1473 degrees K., and at this temperature a virtually complete filling of the pores in the Cr charge with liquid copper is reached after about 30 minutes.

In another embodiment, electrolytically produced chromium is used, which has a maximum oxygen content also of 500 ppm. In this case, however, the Cr powder produced therefrom may have a particle size distribution which is smaller than for alumino-thermally produced chromium, for example having particle sizes of 25 micron and up. Otherwise the various method steps are carried out in accordance with the first example.

After complete filling of the pores, the blanks produced according to the above examples are cooled under vacuum. After cooling, the Cr-Cu compound block can be cut into contact pieces of the required geometry. When making metallographic sections of the material, it can be seen that the compound material produced by the method of the invention has practically no strength-increasing sinter bridges and practically no pores. With this new method, therefore, contact pieces on Cr-Cu base can thus be manufactured reproducibly which have suitable properties for medium-voltage vacuum power switches.

For the embodiments described additional elements can be used as additives. For example, on the one hand, the getter properties can be improved by titanium and zirconium as alloy components to the copper; on the other hand, iron, cobalt or nickel can be added to the Cr powder, in order to improve the wetting properties.

The handling of these additives is controllable in connection with the invention and does not change anything fundamental in the described method.

There has thus been shown and described a novel method for producing a compound material of chromium and copper which fulfills all the object and advantages sought. May changes, modifications, variations and other uses and application of the subject invention will, however, become apparent to those skilled in the art after considering this specification which discloses embodiments thereof. All such changes, modifications, variations and other uses and applications which do not depart from the spirit and scope of the invention are deemed to be covered by the invention which is limited only by the claims which follow.

What is claimed is:

1. A method for producing a compound material of chromium and copper as contact material for medium voltage vacuum power swtiches, comprising the steps:

(a) pouring Cr powder into a degased mold;

(b) placing a piece of low-oxygen copper on the Cr powder;

(c) closing the mold with a porous cover;

(d) degasing the mold in a high-vacuum furnace at room temperature until a pressure of better than $10^{-4}$ mb is reached;

(e) increasing the furnace temperature to as high as possible a temperature below the melting point of copper;

(f) maintaining the furnace temperature at a constant level until a constant internal pressure in the furnace of better than $10^{-4}$ mb is reached; and (g) increasing further the furnace temperature, without intermediate cooling, to a final value of 100 degree K. to 200 degree K. above the melting point of copper and maintaining this temperature until the porosity contained in the Cr powder is completely filled up by liquid copper.

2. The method according to claim 1, characterized in that the furnace temperature in step (e) is $$1273 \text{ degrees K.} \begin{pmatrix} +50 \text{ degrees K.} \\ -20 \text{ degrees K.} \end{pmatrix}.$$

3. The method according to claim 1, characterized in that the pressure in steps (d) and (f) is in the range of $10^{-5}$ mb.

4. The method according to claim 1, characterized in that the furnace temperature in step (f) is maintained for about one hour.

5. The method according to claim 1, characterized in that the temperature in step (g) is maintained for 20 to 30 minutes.

6. The method according to claim 1, characterized in that, when using alumino-thermally produced chromium, the Cr powder produced therefrom has a particle size distribution between 50 micron and 200 micron.

7. The method according to claim 6, characterized in that Cr powder having a particle size with fractions of at least 150 micron is used.

8. The method according to claim 1, characterized in that, when using electrolytically produced chromium, the Cr powder produced therefrom has a particle size distribution between 25 micron and 200 micron.

9. The method according to one of claims 1 to 8, characterized in that a graphite-mold is used.

* * * * *